US011218832B2

(12) United States Patent
Nicol et al.

(10) Patent No.: US 11,218,832 B2
(45) Date of Patent: Jan. 4, 2022

(54) SYSTEM FOR MODELLING ACOUSTIC TRANSFER FUNCTIONS AND REPRODUCING THREE-DIMENSIONAL SOUND

(71) Applicant: Orange, Paris (FR)

(72) Inventors: Rozenn Nicol, Châtillon (FR); Julian Moreira, Châtillon (FR)

(73) Assignee: ORANGE, Paris (FR)

( * ) Notice: Subject to any disclaimer, the term of this patent is extended or adjusted under 35 U.S.C. 154(b) by 0 days.

(21) Appl. No.: 16/189,822

(22) Filed: Nov. 13, 2018

(65) Prior Publication Data

US 2019/0149939 A1 May 16, 2019

(30) Foreign Application Priority Data

Nov. 13, 2017 (FR) ..... 1760647

(51) Int. Cl.
*H04S 7/00* (2006.01)
*H04S 3/00* (2006.01)
*G10K 11/178* (2006.01)

(52) U.S. Cl.
CPC ..... *H04S 7/305* (2013.01); *G10K 11/1781* (2018.01); *H04S 3/002* (2013.01); (Continued)

(58) Field of Classification Search
CPC ..... H04S 7/305; H04S 3/002; H04S 7/306; H04S 7/302; H04S 7/304; H04S 2420/01; (Continued)

(56) References Cited

U.S. PATENT DOCUMENTS 5,742,689 A * 4/1998 Tucker ..... H04S 3/004 381/17
6,181,800 B1 * 1/2001 Lambrecht ..... H04S 1/002 381/17

(Continued)

FOREIGN PATENT DOCUMENTS

CN 103237287 B 3/2015

OTHER PUBLICATIONS

French Search Report dated Sep. 25, 2018 for French Application No. 1760647.

(Continued)

*Primary Examiner* — Jason R Kurr
(74) *Attorney, Agent, or Firm* — Knobbe, Martens, Olson & Bear, LLP

(57) ABSTRACT

Systems and methods are disclosed for modelling of individual acoustic transfer functions relative to the audition of an individual in three-dimensional space. A method is provided for modelling sets of acoustic transfer functions specific to an individual according to a multiplicity of directions in space, where a set of acoustic transfer functions specific to the individual in a given direction is determined depending on the result of a statistical analysis of a plurality of distinct stimuli emitted in the direction of the individual. A stimulus can be dependent on at least one set of predetermined acoustic transfer functions that are associated with the given direction, and on responses received from the individual to each emitted stimulus.

14 Claims, 2 Drawing Sheets

(52) U.S. Cl.
CPC ..... *H04S 7/30* (2013.01); *G10K 2210/3055* (2013.01); *G10K 2210/30232* (2013.01); *H04S 2420/01* (2013.01)

(58) Field of Classification Search
CPC ..... H04S 7/30; G10K 11/1781; G10K 2210/30232; G10K 2210/3055
See application file for complete search history.

(56) References Cited

U.S. PATENT DOCUMENTS

| | | | | |
|---|---|---|---|---|
| 2006/0045294 | A1* | 3/2006 | Smyth | H04S 7/304 381/309 |
| 2008/0130906 | A1 | 6/2008 | Goldstein et al. | |
| 2017/0295445 | A1* | 10/2017 | Christoph | H04S 7/306 |
| 2018/0206058 | A1* | 7/2018 | Murata | H04R 3/04 |
| 2018/0310115 | A1* | 10/2018 | Romigh | H04S 3/008 |

OTHER PUBLICATIONS

Hofman, et al., "Bayesian reconstruction of sound localization cues from responses to random spectra", Biological Cybernetics, 2002, vol. 86, No. 4, pp. 305-316.
Nicol, et al., "How to make immersive audio available for mass-market listening", EBU Technical Review, 2016, pp. 1-18.

* cited by examiner

SYSTEM FOR MODELLING ACOUSTIC TRANSFER FUNCTIONS AND REPRODUCING THREE-DIMENSIONAL SOUND

CROSS-REFERENCE TO RELATED APPLICATIONS

This application claims priority to French Patent Application FR 1760647, filed Nov. 13, 2017, the disclosure of which is incorporated herein by reference in its entirety.

BACKGROUND

Technical Field

Embodiments described herein relate to the modelling of individual acoustic transfer functions, such as acoustic transfer functions that are relative to the audition of an individual in three-dimensional space.

Description of the Related Art

Embodiments described herein are relevant in the context of services, in particular services enabling navigation by spatialized sound, telecommunication services delivering spatialized sound (for example a conference call between a number of individuals, playback of a video such as a cinema trailer, a game, etc.), etc. In telecommunication terminals, in particular mobile terminals, a recreation of sound with stereophonic headphones is envisaged.

Among the audio-spatialization or 3-D sound technologies that employ processing of the audio signal that is in particular applied to the simulation of psycho-acoustic and acoustic effects, certain aim to generate signals to be played over loudspeakers, in particular over loudspeakers that are distant from the listener, or over earpieces, in order to give the listener the auditory illusion of sound sources placed at particular respective positions around him. The creation of virtual sound images and sources is then spoken of. Various techniques are applied to the processing of a 3-D sound intended to be played over headphones comprising two earpieces, such as left and right earphones. These techniques aim to reconstruct, in the ears of a listener, the sound field such that his eardrums perceive a sound field that is practically identical to the field that real sources in 3-D space would have induced. These spatialized sound signals may be obtained in two ways:

- via a direct sound recording, by means of two microphones inserted into the entrance of the ear canal of an individual or a mannequin of standard morphology ("artificial head"), or
- by processing the signal, to create virtual spatialized sounds to be listened to over headphones, for example: by filtering a monophonic signal with two binaural filters, these filters reproducing the properties of the acoustic propagation between the source placed in a given position and the two ears of a listener. Binaural techniques are therefore based on a pair of binaural signals that are fed to the two earpieces of the headphones, respectively.

Binaural synthesis is an effective technique for positioning sound sources in space.

Binaural synthesis is based on the use of what are called "binaural" filters, which reproduce the functions of acoustic transfer between the sound source and the ears of the listener. These filters serve to simulate auditory localization cues, which cues allow a listener to localize sound sources in a real-life listening situation. These filters take into account all the acoustic effects (in particular diffraction by the head and reflections from the outer ear and the top of the torso) that modify the acoustic wave on its path between the source and the ears of the listener. These effects vary greatly with the position of the sound source (mainly with its direction) and these variations allow the listener to localize the source in space. Specifically, these variations define a sort of acoustic code that gives the position of the source. The auditory system of an individual learns to interpret this code in order to localize sound sources. Binaural filters that optionally reproduce the acoustic code that the body of the listener naturally produces, by taking into account the individual particularities of his morphology, are therefore required to achieve high-quality binaural synthesis. This personalization is required to provide a satisfactory and convincing sound quality (quality of the spatialization and of the sound immersion in particular). When these conditions are not met, a decrease in the performance of the binaural rendering is observed: this decrease in performance in particular results in intracranial perception of sources and in front/behind confusions (sources located in front are perceived to be behind and vice versa).

These binaural filters represent acoustic transfer functions, also called HRTFs (acronym of head-related transfer functions), that model the transformations, caused by the torso, the head and the outer ear of the listener, in the signal originating from a sound source. With each sound-source position is associated a pair of individual acoustic transfer functions (an individual acoustic transfer function for the right ear and an individual acoustic transfer function for the left ear). In addition, the individual acoustic transfer functions bear the acoustic imprint of the morphology of the individual on whom they were measured. The individual acoustic transfer functions therefore not only depend on the direction of the sound, but also on the individual. They are thus dependent on the frequency f, on the position (θ□φ) of the sound source (where the angle θ represents the azimuth and the angle φ□elevation) and on the (left or right) ear and on the individual.

Conventionally, individual acoustic transfer functions are obtained by measurement. Initially, a selection of directions, covering more or less finely the whole space surrounding the listener, is decided upon. For each direction, the left and right individual acoustic transfer functions are measured by means of microphones inserted into the entrance of the ear canal of a subject. The measurement must be carried out in an anechoic chamber. In the end, if measurements are taken for M directions, for a given subject, a database of 2M acoustic transfer functions representing each position in space for each ear is obtained. The experimental measurement of individual acoustic transfer functions directly on an individual is, at the present time, the most reliable way of obtaining high-quality binaural filters that are actually personalized (take into account individual particularities and the morphology of the individual).

However, the measurement of these individual acoustic transfer functions presents a few difficulties. It requires specific and expensive equipment (typically an anechoic chamber, a microphone, and a mechanical device for positioning sources). This operation is time-consuming because it is in particular necessary to measure transfer functions for many directions in order to uniformly cover the whole of a 3-D sphere surrounding the listener. Therefore, the measurement procedure is hard work for the subject, in particular because of the constraints imposed on the subject by the measuring system and the duration of the test. This measurement of individual acoustic transfer functions becomes very difficult, or even impossible, in the context of applications of binaural synthesis intended for the general public.

Solutions requiring a minimum of measurements of individual acoustic transfer functions and making greater use of modelling techniques have thus been researched. In particular, mathematical models of individual acoustic transfer functions consisting of a function F allowing an individual acoustic transfer function (Y) to be expressed on the basis of a set of given a priori parameters (X), such that Y=F(X), have been researched. Often, there are two essential elements at play: the development of the mathematical model (function F), and the specification of the set of parameters to be applied as input of the model. The set of parameters consists, for example, in a 3-D mesh of the individual morphology, in particular of the outer ears. The acquisition of a precise mesh remains, at the present time, a critical point.

More simply, databases of acoustic transfer functions have been constructed. These functions are measured on a sample group of individuals and allow a pair of binaural filters to be selected from the database using various techniques, such as a comparison between the morphology of the listener and the morphologies of the sample group of individuals that served to generate the database, or testing of various pairs of binaural filters of the database by the listener. The method of selection of a pair of binaural filters from a database lacks reliability and robustness and may prove to be quite tedious for the user to use.

Embodiments described herein propose an alternative solution that provides improvements with respect to techniques such as those described above.

SUMMARY

In one aspect, a method is provided for modelling sets of acoustic transfer functions specific to an individual according to a multiplicity of directions in space, wherein a set of acoustic transfer functions that are specific to an individual in a given direction of the multiplicity of directions is determined depending on the result of a statistical analysis of a plurality of distinct stimuli emitted in the direction of the individual, a stimulus being dependent on at least one set of predetermined acoustic transfer functions that are associated with the given direction, and on responses received from the individual to each emitted stimulus.

Thus, such embodiments are more reliable and more robust than a simple selection of a set of acoustic transfer functions from a database and mitigates the drawback of the critical acquisition of the 3-D mesh of the individual morphology used by conventional numerical modelling.

In some embodiments, the modelling method includes a statistical analysis by direction in space of the emitted stimuli and of the received responses for the given direction of the multiplicity of directions in space.

Thus, the statistical analysis being implemented by the modelling method, the modelling is more rapid and therefore less tedious for the individual.

In some embodiments, the modelling method includes steps that are carried out for the given direction of the multiplicity of directions in space, in which steps:

- a plurality of distinct stimuli depending on at least one set of predetermined acoustic transfer functions that are associated with the given direction are emitted in the direction of an individual;
- a response of the individual to each emitted stimulus is received.

Thus, the emission of the stimuli and the reception of the responses thereto being implemented by the modelling method, the time lags between the generation of the stimuli and their emission, and the reception of responses and the statistical analysis, respectively, are decreased.

In some embodiments, for the given direction, a plurality of stimuli are generated depending on at least one set of predetermined acoustic transfer functions that are associated with the given direction.

Thus, the generation of the stimuli being implemented by the modelling method, the time lag between the generation of the stimuli and their emission is decreased.

In some embodiments, a stimulus results from the addition of noise to a set of average acoustic transfer functions that are associated with the given direction, said average acoustic transfer functions being calculated depending on sets of acoustic transfer functions, which acoustic transfer functions are recorded in a database of acoustic transfer functions and associated with the given direction.

Thus, the generation of stimuli being based on a set of acoustic transfer functions, it allows the modelling of the acoustic transfer function specific to an individual to be simplified by basing it on the same acoustic transfer function used to generate the stimuli.

In some embodiments, the modelling method includes steps in which:

- a set of average acoustic transfer functions that are associated with the given direction is calculated depending on a plurality of sets of acoustic transfer functions, which acoustic transfer functions are recorded in a database of acoustic transfer functions and associated with the given direction;
- the stimuli are dependent on the set of calculated average acoustic transfer functions.

Thus, the divergence between the set of acoustic transfer functions serving for the modelling and the set of acoustic transfer functions that is specific to the individual is smaller because of the use of average acoustic transfer functions rather than the arbitrary selection of an acoustic transfer function decreasing modelling errors. Therefore, the modelling is less complex and takes less time because it compensates for a smaller divergence.

In some embodiments, the statistical analysis uses the psychophysical technique of reverse correlation.

Thus, the modelling of the set of acoustic transfer functions that is specific to the individual is based on perception, decreasing the risk of intracranial perception and directional confusions.

In some embodiments, the various steps of the method are implemented by a software package or computer program, this software package comprising software instructions intended to be executed by a data processor of a device forming part of a terminal, such as a communication terminal, and being designed to command the execution of the various steps of this method.

In another aspect, a program is provided, the program comprising comprising program-code instructions for executing the steps of the modelling method according to any one of the preceding claims when said program is executed by a processor.

This program may use any programming language and take the form of source code, object code or code intermediate between source code and object code such as code in a partially compiled form or in any other desirable form.

In another aspect, a modeller is provided of sets of acoustic transfer functions specific to an individual according to a multiplicity of directions in space, including a generator of sets of acoustic transfer functions specific to an individual in a given direction of the multiplicity of directions on the basis of the result of a statistical analysis of a plurality of distinct stimuli emitted in the direction of the individual, a stimulus being dependent on at least one set of predetermined acoustic transfer functions that are associated with the given direction, and of responses received from the individual to each emitted stimulus.

In some embodiments, the modeller includes a statistical analyser of the emitted stimuli and of the received responses by given direction of the multiplicity of directions.

In some embodiments, the modeller includes:

an emitter of a plurality of distinct stimuli in the direction of an individual depending on at least one set of predetermined acoustic transfer functions that are associated with at least one given direction of the multiplicity of directions; and a receiver of the responses of the individual to each emitted stimulus.

In another aspect, a three-dimensional sound card is provided, including:

a modeller of sets of acoustic transfer functions specific to an individual according to a multiplicity of directions in space specific to an individual according to a multiplicity of directions in space that is able to generate at least one set of acoustic transfer functions that are specific to an individual in a given direction of the multiplicity of directions on the basis of the result of a statistical analysis of a plurality of distinct stimuli emitted in the direction of the individual, a stimulus being dependent on at least one set of predetermined acoustic transfer functions that are associated with the given direction, and of responses received from the individual to each emitted stimulus, and a set of parallel audio outputs that allow a plurality of loudspeakers to be simultaneously connected to the sound card and that each simultaneously deliver an audio signal to be reproduced to a loudspeaker connected to the audio output, the audio signal including, during a modelling phase, the stimulus corresponding to the loudspeaker and, during a reproducing phase, the signal to be reproduced modified by the function corresponding to the loudspeaker audio output of the set of acoustic transfer functions that are modelled for the individual using the sound card.

In another aspect, a system for reproducing three-dimensional sound is provided, including:

a modeller of sets of acoustic transfer functions specific to an individual according to a multiplicity of directions in space specific to an individual according to a multiplicity of directions in space that is able to generate a least one set of acoustic transfer functions that are specific to an individual in a given direction of the multiplicity of directions on the basis of the result of a statistical analysis of a plurality of distinct stimuli emitted in the direction of the individual, a stimulus being dependent on at least one set of predetermined acoustic transfer functions that are associated with the given direction, and of responses received from the individual to each emitted stimulus, and a set of loudspeakers that are each able to reproduce an audio signal, the audio signal including, during a modelling phase, the stimulus corresponding to the loudspeaker and, during a reproducing phase, a signal to be reproduced modified by the function corresponding to the loudspeaker of the set of acoustic transfer functions that are modelled for the individual using the reproducing system.

In some embodiments, the system includes headphones in which the two loudspeakers of the set of loudspeakers are placed such that each of the two loudspeakers is placed on one of the two ears of the individual when the headphones are placed on his head, and in that the set of acoustic transfer functions is a corresponding pair of transfer functions.

BRIEF DESCRIPTION OF THE DRAWINGS

The features and advantages of the embodiments described herein will become more clearly apparent on reading the description, which is given by way of example, and the figures referred to thereby, which show.

DETAILED DESCRIPTION

Figure 1:
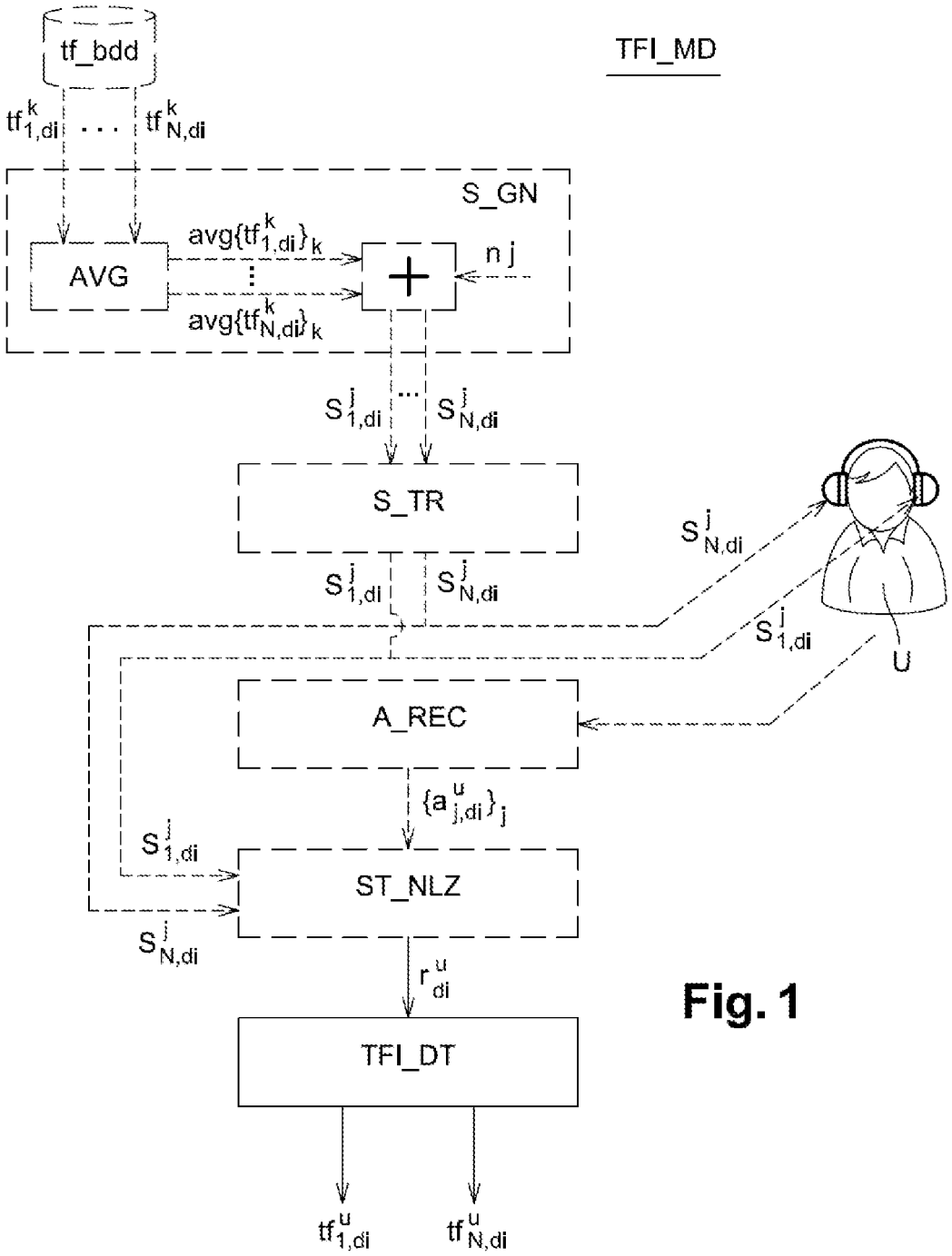
FIG. 1, a simplified schematic of a method for modelling a set of individual acoustic transfer functions.

FIG. 1 illustrates a simplified schematic of a method for modelling a set of individual acoustic transfer functions. The method for modelling sets of acoustic transfer functions TFI_MD is specific to an individual according to a multiplicity of directions in space. This modelling method TFI_MD includes determining TFI_DT a set of acoustic transfer functions ($tf_{1,di}^{U}, \ldots tf_{N,di}^{U}$) specific to an individual U in a given direction di of the multiplicity of directions depending on the result $r_{di}^{U}$ of a statistical analysis of a plurality of distinct stimuli $\{(s_{1,di}^{j}, \ldots s_{N,di}^{j}))\}^{j}$ emitted in the direction of the individual U, and on responses $\{s_{j,di}^{U}\}$, received from the individual U to each emitted stimulus. A stimulus is dependent on at least one set of predetermined acoustic transfer functions that are associated with the given direction.

By direction in space associated with an acoustic transfer function what is in particular meant is a direction, relative to the user, in which a virtual source is created by means of the modelling.

In particular, the modelling method TFI_MD includes a statistical analysis ST_NLZ by direction di in space of the emitted stimuli ($s_{1,di} \ldots s_{N,di}$) and of the received responses $a_{di}^{U}$.

In particular, the modelling method TFI_MD includes the following steps, which are carried out for the given direction di of the multiplicity of directions in space:

a plurality of distinct stimuli depending on at least one set of predetermined acoustic transfer functions that are associated with the given direction di are emitted S_TR in the direction of an individual U;

a response of the individual U to each emitted stimulus is received A_REC.

In particular, for the given direction di, a plurality of stimuli are generated S_GN depending on at least one set of predetermined acoustic transfer functions that are associated with the given direction.

In particular, a stimulus $s_{1,di}^{j} \ldots s_{N,di}^{j}$ results from the addition+of noise $n_j$ to a set of average acoustic transfer functions $avg\{tf_{1,di}^{k}\}^{k} \ldots avg\{tf_{N,di}^{k}\}^{k}$ that are associated with the given direction di and that are calculated depending on sets of acoustic transfer functions that are recorded in a database tf_bdd of acoustic transfer functions and that are associated with the given direction.

The addition of noise to generate the stimuli allows the variation space to be explored without a priori hypotheses as to the properties of the spectral profile (of the set of individual acoustic transfer functions) that are responsible for the localization in a given direction (for example the frontal direction).

In particular, the modelling method TFI_MD includes the following steps in which

- a set of average acoustic transfer functions that are associated with the given direction is calculated AVG depending on a plurality of sets of acoustic transfer functions that are recorded in a database of acoustic transfer functions and that are associated with the given direction;
- the stimuli are dependent on the set of calculated average acoustic transfer functions.

By set of average acoustic transfer functions what is meant is one average acoustic transfer function per reproduction channel, in particular in the case of binaural synthesis: an average acoustic transfer function for the right ear and an average acoustic transfer function for the left ear of the user U.

In particular, the statistical analysis ST_NLZ uses the psychophysical technique of reverse correlation. It is based on the high-level observation of perceptive processes and employs a testing phase during which the modelling method TFI_MD subjects the individual to a set of stimuli that are obtained by adding noise to a neutral stimulus (for example an average of acoustic transfer functions) and observes the responses of the individual U to these various stimuli. By analysing the statistical relationships between the stimuli and the responses, the modelling method TFI_MD identifies TFI_DT the perceptive filters, in the present case the individual acoustic transfer functions, associated with the studied perceptive process, i.e. the properties of the stimuli that define a given perceptive response.

Thus, the modelling method is based on perception to identify the acoustic transfer functions specific to an individual.

The modelling of frontal sound sources (direction of 0° azimuth and 0° elevation) is particularly critical. The use of generic binaural filters in such modelling engenders a spatialization of sound sources that is often disappointing: the listener tends to locate the source above, or even inside his head.

Using the modelling method TFI_MD, a pair of neutral binaural filters (i.e. a set of what are called neutral acoustic transfer functions) is calculated by averaging AVG a plurality of sets of acoustic transfer functions HRTF, which functions are measured in the frontal direction for a large selection of individuals forming a sample group (said functions optionally being pre-recorded in a database of sets of acoustic transfer functions tf_bdd).

A set of spatialized stimuli synthesized S_GN with binaural filters obtained by adding+noise $n_j$ to the pair of neutral filters is played S_TR for the intention of the listener, i.e. of the individual U for whom the modelling method TFI_MD determines the set of personalized acoustic transfer functions. The addition of noise affects the spectral profile.

For each emitted stimulus, the listener U indicates whether he perceives it to be correctly spatialized (i.e. in the direction di that the modelling TFI_MD is attempting to reproduce, in the present case the frontal direction and outside his head) or not. This indication of the listener U forms the response a received A_REC during the modelling TFI_MD.

The analysis ST_NLZ of the statistical relationships between the stimuli and the responses of the author make it possible to determine TFI_DT the spectral profile suited to the listener U and guaranteeing the correct reproduction of sounds in the modeled direction di, in the present case the frontal direction.

This modelling method TFI_MD may be applied to any other direction.

One particular embodiment of the modelling method is a program comprising program-code instructions for executing the steps of the modelling method when said program is executed by a processor.

Figure 2:
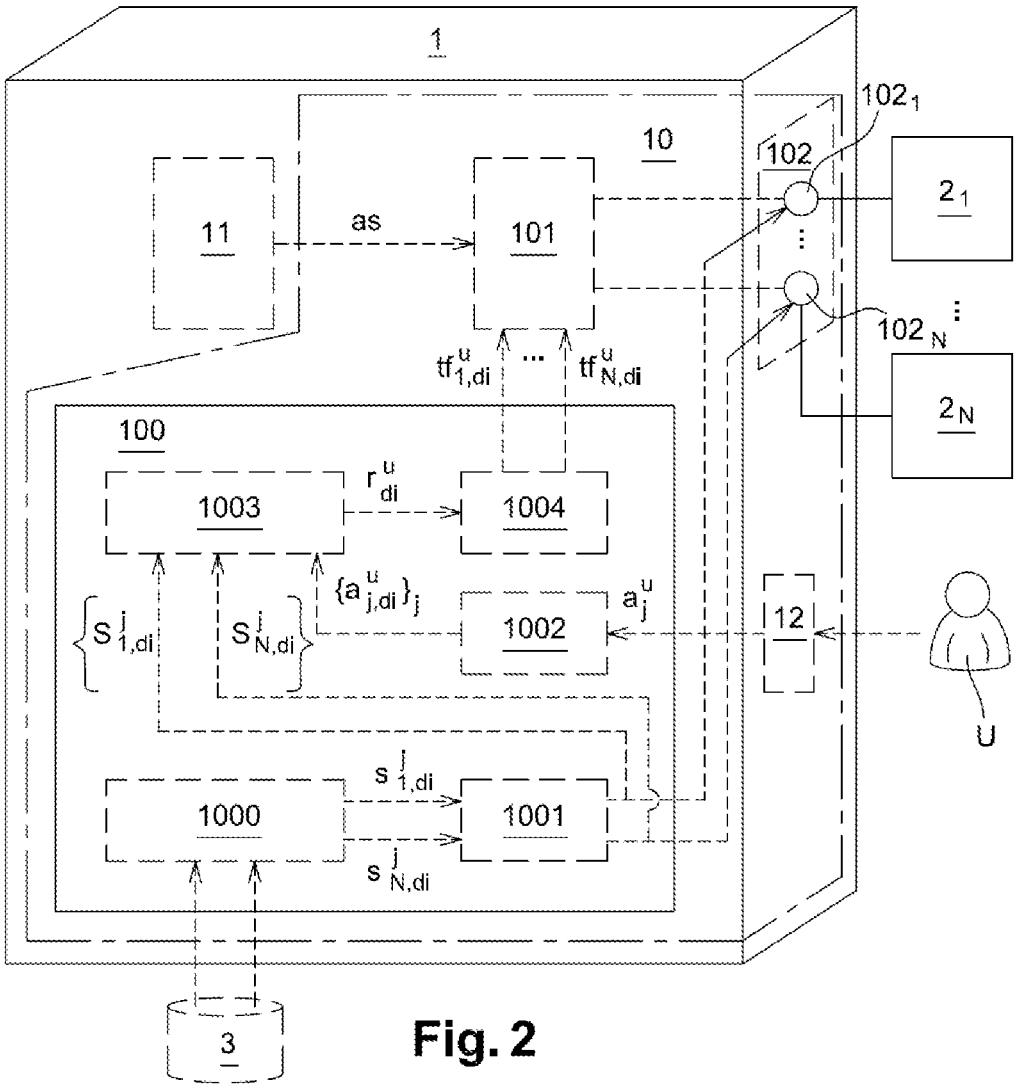
FIG. 2, a simplified schematic of a modeller of a set of individual acoustic transfer functions.

FIG. 2 shows a simplified schematic of a model of a set of individual acoustic transfer functions.

The modeller 100 of sets of acoustic transfer functions specific to an individual according to a multiplicity of directions in space specific to an individual according to a multiplicity of directions in space, includes a generator 1004 of sets of acoustic transfer functions specific to an individual in a given direction of the multiplicity of directions on the basis of the result of a statistical analysis of a plurality of distinct stimuli emitted in the direction of the individual, a stimulus being dependent on at least one set of predetermined acoustic transfer functions that are associated with the given direction, and of responses received from the individual to each emitted stimulus.

In particular, the modeller 100 includes a statistical analyser 1003 of the emitted stimuli and of the received responses by given direction of the multiplicity of directions.

In particular, the modeller 100 includes:

- an emitter 1001 of a plurality of distinct stimuli in the direction of an individual depending on at least one set of predetermined acoustic transfer functions that are associated with at least one given direction of the multiplicity of directions; and
- a receiver 1002 of the responses of the individual to each emitted stimulus.

In one particular embodiment, a three-dimensional sound card 10 includes:

- a modeller 100 of sets of acoustic transfer functions specific to an individual according to a multiplicity of directions in space that is able to generate at least one set of acoustic transfer functions that are specific to an individual in a given direction of the multiplicity of directions on the basis of the result of a statistical analysis of a plurality of distinct stimuli emitted in the direction of the individual, a stimulus being dependent on at least one set of predetermined acoustic transfer functions that are associated with the given direction, and of responses received from the individual to each emitted stimulus, and
- a set 102 of parallel audio outputs that allow a plurality of loudspeakers $\mathbf{2}_1 \ldots \mathbf{2}_N$ to be simultaneously connected to the sound card and that each simultaneously deliver an audio signal to be reproduced to a loudspeaker connected to the audio output, the audio signal including, during a modelling phase, the stimulus corresponding to the loudspeaker and, during a reproducing phase, the signal to be reproduced modified by the function corresponding to the loudspeaker audio output of the set of acoustic transfer functions that are modelled for the individual using the sound card.

In particular, the modeller 100 includes a stimulus generator 1000 that delivers, for a given direction di, a plurality (j) of sets of stimuli ($s_{1,di}^{j} \ldots s_{N,di}j$). The generator 1000 in particular adds, for each set of stimuli ($s_{1,di}^{j} \ldots s_{N,di}^{j}$), noise $n_j$ to a given set of predetermined acoustic transfer functions ($tf_{1,di}^{k'} \ldots tf_{N,di}^{k'}$). The noise $n_3$ applied to the set of predetermined acoustic transfer functions ($tf_{1,di}^{k'} \ldots tf_{N,di}^{k'}$) to obtain the set of stimuli ($s_{1,di}^{j} \ldots s_{N,di}^{j}$) is distinct from the noise $n_{j'}$ applied to the same set of predetermined acoustic transfer functions ($tf_{1,di}^{k'} \ldots tf_{N,di}^{k'}$) to obtain the set of stimuli ($s_{1,di}^{j'} \ldots s_{N,di}^{j'}$).

The predetermined set of acoustic transfer functions that is used to generate the stimuli is in particular a set of what are called neutral acoustic transfer functions, namely it does not reflect a specific morphology. Thus, the statistical analysis is not biased by a particular morphological model and the determination of the individual acoustic transfer functions allows a better approximation of the actual acoustic transfer functions of the individual.

In particular, such a what is called neutral set of acoustic transfer functions is obtained by averaging a plurality of sets of acoustic transfer functions, which functions are recorded in a database of acoustic transfer functions. For example, those sets of acoustic transfer functions which are used to calculate this what is called neutral set of acoustic transfer functions are selected randomly from the database of acoustic transfer functions or depending on one or more morphological parameters neighbouring those of the individual, or consist of all the sets of acoustic transfer functions that are recorded in the database of acoustic transfer functions.

Most often a set of acoustic transfer functions is a pair of acoustic transfer functions (for example in the particular case of binaural stimulation) that is composed of the acoustic transfer function corresponding to the right ear and of the acoustic transfer function corresponding to the left ear of an individual.

The emitter 1001 emits, for at least one given direction di, a plurality of sets of stimuli ($s_{1,di}^{j} \ldots s_{N,di}^{j}$) in the direction of the individual U for whom the modeller 100 determines a set of acoustic transfer functions in a given direction di. In particular, the emitter 1001 transmits these sets of stimuli, for example via an output assembly 102 of a 3-D sound card 10 and/or of a terminal 1 including the modeller 100, to a set of loudspeakers ($\mathbf{2}_1 \ldots \mathbf{2}_N$) that play the stimuli to the individual U. Each stimuli $s_{n,di}^{j}$ of a set of stimuli is intended for a specific loudspeaker $\mathbf{2}_n$ of the set of loudspeakers ($\mathbf{2}_1 \ldots \mathbf{2}_N$).

To each set of stimuli ($s_{1,di}^{j} \ldots s_{N,di}^{j}$), the individual U reacts by transmitting a response a in particular by means of an interface 12 of the terminal 1 (by input, by voice command, etc.). The receiver 1002 receives the response $a_j^U$ to the set j of stimuli of the individual U.

For a given direction di, the analyser 1003 carries out a statistical analysis on the sets of emitted stimuli ($s_{1,di}^{j} \ldots s_{N,di}^{j}$) and the corresponding responses $a_j^U$. The generator 1004 then determines the set ($tf_{1,di}^{j} \ldots tf_{N,diU}$) of acoustic transfer functions that is specific to this individual U for the given direction di depending on the result $r_{di}^U$ delivered by the analyser 1003.

The operation is optionally repeated for one or more other distinct directions di'.

Thus, the terminal 1 including a reader 11 of a sound signal as may play a 3-D sound signal in the direction of the individual U. Specifically, the terminal 1 includes a filter 101 the filtering parameters of which are formed, for a least one direction di, by the transfer-function set delivered by the modeller 100. The filter 101 then converts the monophonic sound signal as with a set of sound signals that are played to the individual U by means of the set of loudspeakers.

Figure 3:
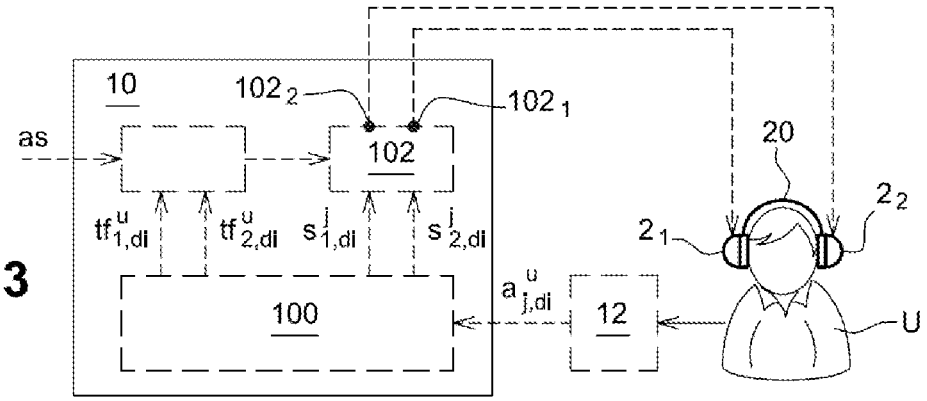
FIG. 3, a simplified schematic of a system for reproducing three-dimensional sound.

FIG. 3 illustrates a simplified schematic of a system for reproducing three-dimensional sound.

The system for reproducing three-dimensional sound includes:

- a modeller 100 of sets of acoustic transfer functions specific to an individual according to a multiplicity of directions in space that is able to generate at least one set of acoustic transfer functions that are specific to an individual in a given direction of the multiplicity of directions on the basis of the result of a statistical analysis of a plurality of distinct stimuli emitted in the direction of the individual, a stimulus being dependent on at least one set of predetermined acoustic transfer functions that are associated with the given direction, and of responses received from the individual to each emitted stimulus, and
- a set of loudspeakers {$\mathbf{2}_1$, $\mathbf{2}_2$} that are each able to reproduce an audio signal, the audio signal including, during a modelling phase, the stimulus corresponding to the loudspeaker and, during a reproducing phase, to a signal to be reproduced modified by the function corresponding to the loudspeaker of the set of acoustic transfer functions that are modelled for the individual using the reproducing system.

In particular, the reproducing system includes headphones 20 in which the two loudspeakers $\mathbf{2}_1$ and $\mathbf{2}_2$ of the set of loudspeakers are placed such that each of the two loudspeakers is placed on one of the two ears of the individual U when the headphones 20 are placed on his head, the set of acoustic transfer functions being a corresponding pair of transfer functions.

Thus, the modelling does not require specific equipment. It may be implemented with a simple set of headphones.

The embodiments described herein also relate to a medium. The data medium may be any entity or device capable of storing the program. For example, the medium may include a storing means, such as a ROM, for example a CD-ROM or a microelectronic circuit ROM or even a magnetic recording means, for example a floppy disk or a hard disk.

Furthermore, the data medium may be a transmissible medium such as an optical or electrical signal that may be transmitted via an optical or electrical cable, by radio or by other means. The program may in particular be downloaded from a network, the Internet in particular.

Alternatively, the data medium may be an integrated circuit in which the program is incorporated, the circuit being suitable for executing or for being used in the execution of the method in question.

In another implementation, the embodiments described herein are implemented by means of software and/or hardware components. In this light, the term module may correspond either to a software component or to a hardware component. A software component corresponds to one or more computer programs, one or more sub-programs of a program, or more generally to any element of a program or of a software package able to implement a function or a set of functions according to the above description. A hardware component corresponds to any element of a hardware assembly able to implement a function or a set of functions.

In the foregoing description, specific details are given to provide a thorough understanding of the examples. However, it will be understood by one of ordinary skill in the art that the examples may be practiced without these specific details. Certain features that are described separately herein can be combined in a single embodiment, and the features described with reference to a given embodiment also can be implemented in multiple embodiments separately or in any suitable subcombination.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A method for modelling individual-specific sets of acoustic transfer functions specific to an individual according to more than two directions in space for use in reproducing three-dimensional sound, the method comprising:

determining an individual-specific set of acoustic transfer functions that are specific to an individual in a given direction of the more than two directions, the determining comprising calculating the individual-specific set of acoustic transfer functions using a statistical analysis of:

a plurality of distinct stimuli emitted for the individual in a given direction, a stimulus of the plurality of distinct stimuli dependent upon at least one first set of predetermined acoustic transfer functions that are associated with the given direction, a first set of predetermined acoustic transfer functions comprising at least two predetermined acoustic transfer functions, and a plurality of responses received from the individual to the plurality of emitted stimuli, each response giving information related to the emission direction perceived by the individual.

2. The modelling method of claim 1, additionally comprising carrying out the statistical analysis by direction in space of the plurality of distinct stimuli and of the received responses for the given direction of the more than two directions in space.

3. The modelling method of claim 1, additionally comprising, for the given direction of the more than two directions in space:

emitting, for the individual from the given direction, the plurality of distinct stimuli depending on at least one set of predetermined acoustic transfer functions that are associated with the given direction; and receiving a response of the individual to each emitted stimulus.

4. The modelling method of claim 1, additionally comprising generating, for the given direction, the plurality of distinct stimuli depending on at least one set of predetermined acoustic transfer functions that are associated with the given direction.

5. The modelling method of claim 1, wherein a stimulus results from the addition of noise to a set of average acoustic transfer functions that are associated with the given direction, the average acoustic transfer functions calculated depending on sets of acoustic transfer functions, and wherein the acoustic transfer functions are recorded in a database of acoustic transfer functions and associated with the given direction.

6. The modelling method of claim 1, additionally comprising calculating a set of average acoustic transfer functions that are associated with the given direction depending on a plurality of sets of acoustic transfer functions, wherein the acoustic transfer functions are recorded in a database of acoustic transfer functions and associated with the given direction, and wherein the stimuli are dependent on the set of calculated average acoustic transfer functions.

7. The modelling method of claim 1, wherein the statistical analysis uses a psychophysical technique of reverse correlation.

8. A non-transitory computer-readable medium comprising instructions, which when executed by a processor, cause the processor to perform the modelling method of claim 1.

9. A modeller of sets of individual-specific acoustic transfer functions specific to an individual according to more than two directions in space for use in reproducing three-dimensional sound, the modeller configured to generate individual-specific sets of acoustic transfer functions specific to an individual in a given direction of the more than two directions, the generation comprising calculating the individual-specific set of acoustic transfer functions using a statistical analysis of:

a plurality of distinct stimuli emitted for the individual from the given direction, a stimulus of the plurality of distinct stimuli dependent on at least one first set of predetermined acoustic transfer functions that are associated with the given directions first set of predetermined acoustic transfer functions comprising at least two predetermined acoustic transfer functions, and a plurality of responses received from the individual to the plurality of emitted stimuli, each response giving information related to the emission direction perceived by the individual.

10. The modeller of claim 9, wherein the modeller is configured to statistically analyze the emitted stimuli and the received responses by the given direction of the at least two directions.

11. The modeller of claim 9, wherein the modeller includes:

an emitter configured to emit the plurality of distinct stimuli for the individual from the given direction; and a receiver configured to receive the responses of the individual to each emitted stimulus.

12. A three-dimensional sound card including:

a modeller of sets of individual-specific acoustic transfer functions specific to an individual according to more than two directions in space, the modeller configured to generate at least one set of individual-specific acoustic transfer functions specific to the individual in a given direction of the more than two directions, the generation comprising calculating the individual-specific set of acoustic transfer functions using a statistical analysis of:

a plurality of distinct stimuli emitted for the individual from the given direction, a stimulus of the plurality of distinct stimuli dependent on at least one first set of predetermined acoustic transfer functions that are associated with the given direction, a first set of predetermined acoustic transfer functions comprising at least two predetermined acoustic transfer functions, and a plurality of responses received from the individual to the plurality of emitted stimuli, each response giving information related to the emission direction perceived by the individual; and a set of parallel audio outputs configured to allow a plurality of loudspeakers to be simultaneously connected to the sound card and configured to each simultaneously deliver an audio signal to be reproduced to a loudspeaker connected to the audio output, the audio signal including, during a modelling phase, the stimulus corresponding to the loudspeaker and, during a reproducing phase, the signal to be reproduced modified by the function corresponding to the loudspeaker audio output of the set of individual-specific acoustic transfer functions that are calculated for the individual using the sound card.

13. A system for reproducing three-dimensional sound, including:

a modeller of sets of individual-specific acoustic transfer functions specific to an individual according to more than two directions in space, the modeller configured to generate at least one set of individual-specific acoustic transfer functions specific to the individual in a given direction of the more than two directions, the generation comprising calculating the individual-specific set of acoustic transfer functions using a statistical analysis of:

a plurality of distinct stimuli emitted for the individual from the given direction, a stimulus of the plurality of distinct stimuli dependent on at least one first set of predetermined acoustic transfer functions that are associated with the given direction, a first set of predetermined acoustic transfer functions comprising at least two predetermined acoustic transfer functions, and a plurality of responses received from the individual to the plurality of emitted stimuli, each response giving information related to the emission direction perceived by the individual, and a set of loudspeakers, each loudspeaker of the set of loudspeakers able to reproduce an audio signal, the audio signal including, during a modelling phase, the stimulus corresponding to the loudspeaker and, during a reproducing phase, a signal to be reproduced modified by the function corresponding to the loudspeaker of the set of individual-specific acoustic transfer functions that are calculated for the individual using the sound card.

14. The system of claim 13, the system additionally including headphones in which two loudspeakers of the set of loudspeakers are placed such that each of the two loudspeakers is placed on one of the two ears of the individual when the headphones are placed on the head of the individual, wherein the set of acoustic transfer functions is a corresponding pair of transfer functions.

* * * * *